United States Patent [19]

Andre et al.

[11] Patent Number: 4,741,382

[45] Date of Patent: May 3, 1988

[54] PROCESS FOR PRODUCING PIGS AS FINISHED PRODUCTS

[75] Inventors: Jacques Andre, Waterloo, Belgium; Raoul Colin, Grand-Lancy, Switzerland

[73] Assignee: ACEC-Heating, Brussels, Belgium

[21] Appl. No.: 1,475

[22] Filed: Jan. 8, 1987

[51] Int. Cl.[4] ..... B22D 5/04

[52] U.S. Cl. ..... 164/457; 164/136

[58] Field of Search ..... 164/130, 136, 322, 323, 164/324, 329, 4.1, 457, 133

[56] References Cited

U.S. PATENT DOCUMENTS 3,052,934 9/1962 Kerber ..... 164/130

4,509,578 4/1985 Shaw ..... 164/457

FOREIGN PATENT DOCUMENTS 37-9657 7/1962 Japan ..... 164/329

*Primary Examiner*—Nicholas P. Godici

*Assistant Examiner*—Richard K. Seidel

*Attorney, Agent, or Firm*—Schwartz, Jeffery, Schwaab, Mack, Blumenthal & Evans

[57] ABSTRACT

A process for producing pigs as finished products using molds equipped with at least one spout with a stairway-shaped profile having at least two steps. The molds are filled from a ladle containing molten metal via a movable runner equipped with a handling means. The steps of the spout or spouts during the filling of a mold, and the sudden movement of the runner are observed in order to direct the casting jet outside the mold, while acting on the handling means, as soon as the molten metal spreads over a specified step of the spout.

4 Claims, 1 Drawing Sheet

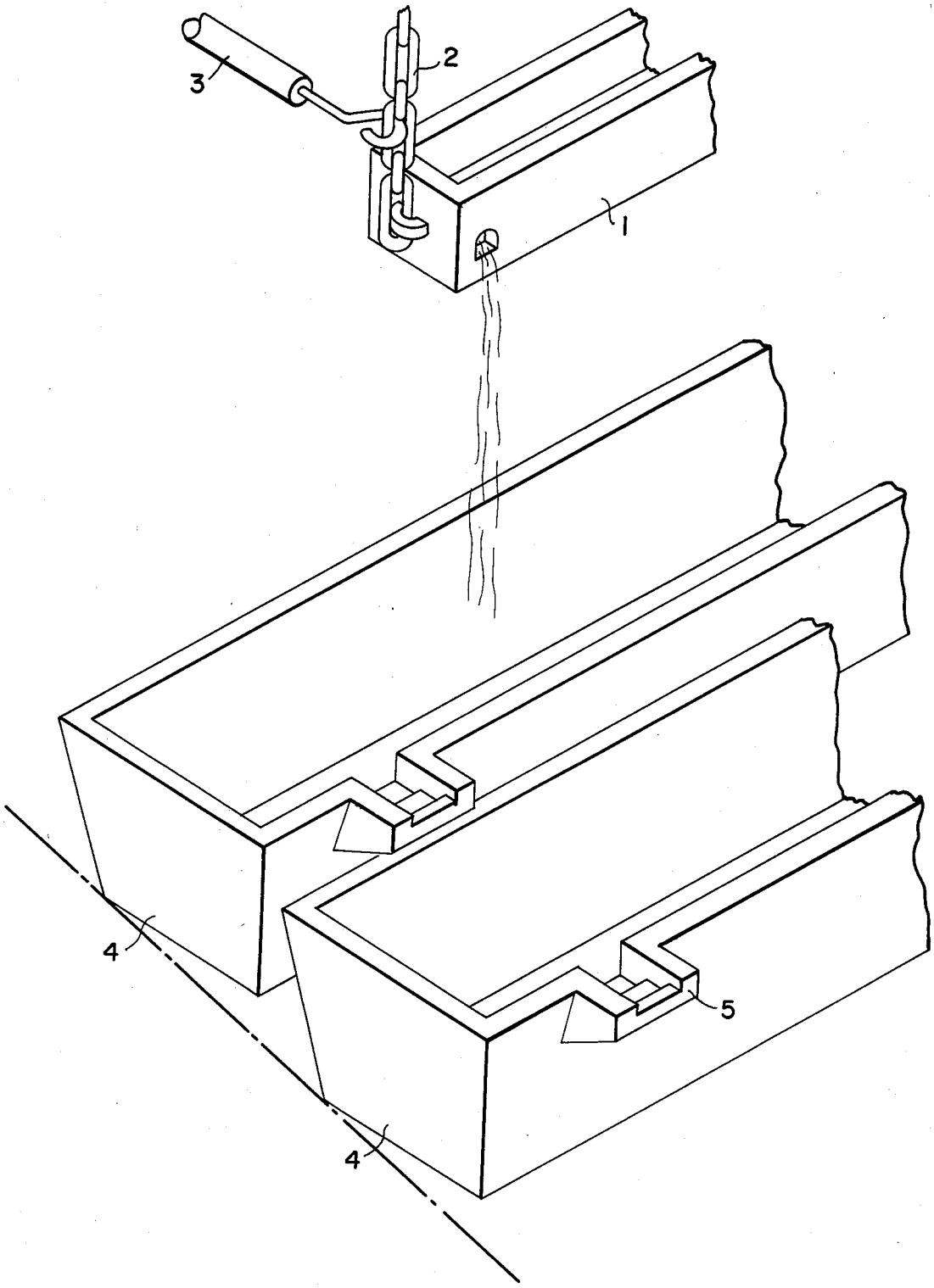
2
3
1
4
5
4

PROCESS FOR PRODUCING PIGS AS FINISHED PRODUCTS

BACKGROUND OF THE INVENTION

The production of pigs is known. According to a conventional process, molten metal is poured from a ladle into molds arranged side by side on an inclined plane. The molds can be connected to one another in order to form an endless chain which travels underneath a spout of the ladle. Each mold has at least one spout. At the place where they are filled with molten metal, the molds are arranged in such a way that the spout of the mold located underneath the runner can pour into the next lower mold. The overflow from a mold via the usually very wide spout determines the height or thickness of the pig.

This method of producing pigs by overflow makes it possible to obtain pigs as semi-finished or rough products, the height of which vary between 55 and 65 mm, for example for a nominal height of 60 mm. The height variation observed in this way is attributable partly to the variation in temperature of the molten metal and partly to other causes, such as, for example, the partial obstruction of the spout by slag.

If, on the other hand, the pigs are to be used as finished products, such a large variation in height is unacceptable. This applies particularly to pigs serving as counterweights or pigs used in stacks for the heat-accumulating cores of ovens.

SUMMARY OF THE INVENTION

The object of the invention is a process for producing pigs as finished products, the thicknesses of which have a spread of the order of only 2 millimeters.

The process according to the invention is defined in that it makes use of molds, the spouts of which have a stairway-shaped profile with at least two steps, with step heights preferably between 1 and 3 mm, and in that the pouring of the molten metal into the mold is stopped at the moment when the molten metal spreads over a specific step. The horizontal dimensions of the steps are preferably of the order of 10 mm.

BRIEF DESCRIPTION OF THE DRAWING

The invention is described below with reference to the accompanying drawing.

DETAILED DESCRIPTION OF THE PREFERRED EMBODIMENT

The single FIGURE of this drawing shows, in perspective, a runner, one end 1 of which is suspended on a chain 2 and is equipped with a handling arm 3, as well as two molds 4 of a chain of molds. Each mold has two spouts 5, only one of which can be seen in the drawing. The profile of these spouts is stairway-shaped. The heights between the first and second steps and the second and third steps of the stairway are 2 mm in this particular case. They can be even lower or a little higher. These steps of low height and of horizontal dimensions of approximately 10 mm make it possible to set the height of the molten metal in the mold with very high accuracy. In fact, as soon as the liquid metal spreads, for example, over the second step, this spreading takes place very quickly. Consequently, the moment when the molten metal reaches the level of this step can be detected by the founder with great accuracy. The runner is then abruptly moved to a point above the next mold. The third step of the spout thus no longer serves for the overflow. Consequently, it is not damaged by erosion attributable to the passage of the molten metal. However, it can still perform this function in the event of irregularities in the flow of the molten metal through the runner 1 or other occasional incidents.

The molds preferably have two spouts, one at each end. This makes it possible to check easily and at any moment whether the molds are perfectly horizontal and, if appropriate, correct their position. If the moments when the molten metal spreads over the steps of the spouts are unequal as a result of an incorrect choice of the point of impact of the casting jet and/or an unsuitable direction of this jet in relation to the mold, this can easily be corrected by the founder who watches the spout.

Means not shown in the drawing, but easy for a person skilled in the art to conceive can be provided in the support of the molds in order to correct a fault in the horizontal position of these. These means can be actuated especially when the molten metal spreads over the lowest steps at unequal moments, in order to ensure simultaneous spreading over the upper steps where the filling of the mold is stopped abruptly.

The accuracy obtained for the height of the pigs can be maintained at 60+2 mm. This applies even if the steps of the spouts have heights of 3 mm, because the pouring of the molten metal is stopped abruptly as soon as the molten metal spreads over the specified step, without waiting until it fills the step. It goes without saying that a mold cannot be filled too quickly, since the sudden movement may require 0.2 seconds. To achieve an accuracy of 3% in the height, the filling time must exceed 6 seconds and preferably be much longer.

We claim:

1. A process for producing pigs as finished products, providing molds equipped with at least one spout with a stairway-shaped profile having at least two steps, filling the molds from a ladle containing molten metal via a movable runner equipped with a handling means, observing the steps of the spout or spouts during the mold filling, and as soon as the molten metal spreads over a specified step of the spout, acting on the handling means for sudden movement of the runner in order to direct the casting jet outside of the mold.

2. A process as claimed in claim 1, including connecting the molds in an endless chain traveling under the runner and wherein, at the moment of sudden movement of the runner, directing the casting jet into the next mold.

3. A process as claimed in claim 2, including moving the molds along an inclined plane, arranging the spouts of the upper molds so as to pour into the next lower molds, filling the upper molds before the lower molds.

4. A process as claimed in claim 1, including providing molds with two spouts, one at each end, wherein the spreading of the molten metal over specific steps of the spouts is observed simultaneously.

* * * * *